United States Patent [19]

Pieper

[11] Patent Number: 4,750,632

[45] Date of Patent: Jun. 14, 1988

[54] APPARATUS PROVIDING DRIPLESS FEATURE TO LIQUID CONTAINER

[76] Inventor: Julius A. Pieper, 6520 N. Atwahl Dr., Milwaukee, Wis. 53209

[21] Appl. No.: 597

[22] Filed: Jan. 6, 1987

[51] Int. Cl.[4] ..... B65D 19/22; B65D 23/03

[52] U.S. Cl. ..... 270/23.83; 206/502; 215/100.5; 270/70

[58] Field of Search ..... 220/23.83, 23.86, 70; 206/502; 215/100.5

[56] References Cited

U.S. PATENT DOCUMENTS

| | | | |
|---|---|---|---|
| 689,014 | 12/1901 | Madancy . | |
| 1,576,319 | 3/1926 | Fagley . | |
| 2,089,624 | 8/1937 | Smith . | |
| 2,119,342 | 5/1938 | Morris . | |
| 2,210,283 | 8/1940 | Cowan | 206/502 |
| 2,548,035 | 4/1951 | May . | |
| 2,564,834 | 8/1951 | Devine | 206/508 |
| 2,667,360 | 1/1954 | Leystra . | |
| 2,750,769 | 6/1956 | Yost et al. . | |
| 2,755,644 | 7/1956 | Watson | 206/502 |
| 2,847,144 | 8/1958 | Cornelius . | |
| 4,463,860 | 8/1984 | Yoshino et al. . | |
| 4,506,799 | 3/1985 | Mason, Jr. . | |

FOREIGN PATENT DOCUMENTS

| | | | |
|---|---|---|---|
| 141080 | 5/1903 | Fed. Rep. of Germany | 220/23.83 |
| 25410 | of 1902 | United Kingdom | 220/23.83 |

*Primary Examiner*—George E. Lowrance

*Attorney, Agent, or Firm*—Andrus, Sceales, Starke & Sawall

[57] ABSTRACT

An apparatus for providing dripless consumption of a consumable liquid includes a preferably concave saucer and a container having a liquid-receiving body with a flange provided at its bottom. The flange has a series of indentations formed therein that act to retain liquid during the drinking sequence, and prevent liquid found on the exterior of the container from dripping onto the user.

18 Claims, 1 Drawing Sheet

APPARATUS PROVIDING DRIPLESS FEATURE TO LIQUID CONTAINER

BACKGROUND OF THE INVENTION

This invention relates to liquid containers having a drip prevention feature and more particularly to drinking containers, such as cups, and associated dishes, such as saucers, having this feature.

The common beverage containers, such as pitchers, coffee cups, or water glasses, are intended to receive and hold liquid within the vessel. However, there are times when, due to spilling or condensation, liquid is present on the exterior surfaces of the container. When this occurs, it is common for the liquid to collect on the bottom of the container. The accumulation of the liquid on the bottom of the container often results in the liquid dripping onto the user or his/her apparel during drinking or pouring. The present invention is designed to prevent this dripping of liquid found on the exterior of a liquid container.

SUMMARY OF THE INVENTION

The present invention provides a liquid receptacle apparatus comprising a drinking vessel or container and a receiver, such as a saucer. The saucer has a generally flat surface on which the container rests. The saucer is typically provided with a lip to define a container-receiving area. The container has a liquid-receiving body with a flange provided at the bottom of the body adapted to fit on the container-receiving area of the saucer. A series of indentations is provided in the flange, with each indentation extending above the top of the lip on the saucer. The indentations prevent dripping during drinking or pouring by retaining the liquid present on the exterior of the container when the container is lifted and tilted.

DETAILED DESCRIPTION OF THE PREFERRED EMBODIMENT

Figure 1:
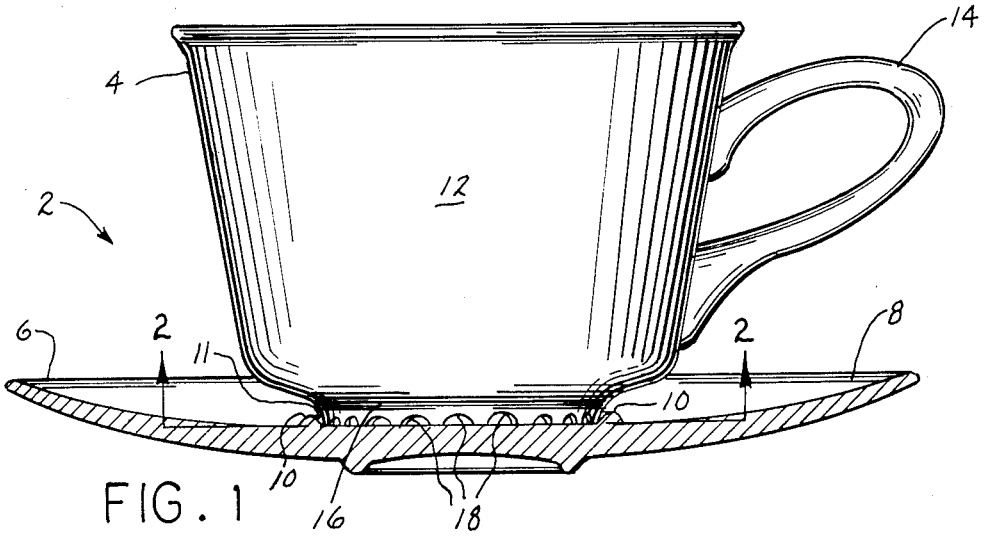
FIG. 1 is an elevational view of the drinking apparatus of the present invention, showing a cross-section of a receiver in the form of a saucer.

Referring now to FIG. 1, a liquid receptacle apparatus 2 comprises a beverage vessel or container, such as coffee cup 4, and saucer 6. Saucer 6 is of conventional construction, presenting a concave surface 8. Concave surface 8 has an upstanding circular lip 10, to define a generally flat container-receiving area 11.

Cup 4 has a liquid-receiving body 12, with attached handle 14. Cup 4 is constructed of any suitable material, such as ceramic or glass.

Figure 2:
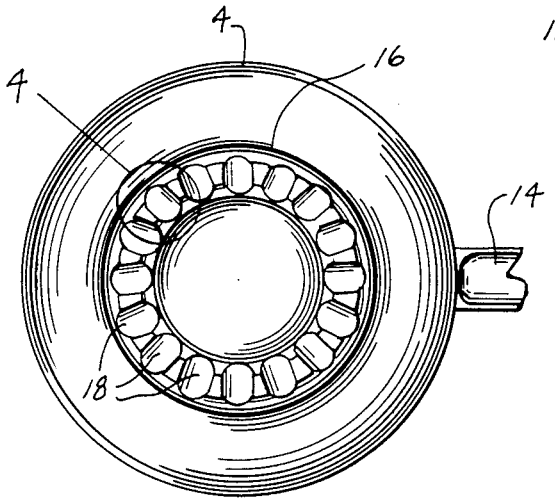
FIG. 2 is a plan view along line 2—2 of FIG. 1, showing the bottom of the container.
Figure 3:
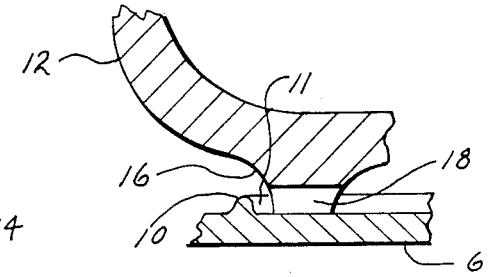
FIG. 3 is an enlarged partial cross-section view of a portion of the container and saucer shown in FIG. 1.

Liquid-receiving body 12 of cup 4 is provided at its bottom, with circular flange 16, as shown in FIG. 2. Flange 16 is shaped so as to fit within container-receiving area 11 defined by lip 10. A series of indentations 18 is provided in flange 16. Indentations 18 are spaced around the circumference of flange 16. Indentations 18 are arcuate in cross-section, and the topmost point of the arc of each indentation 18 extends above the top of lip 10 when cup 4 is placed within container-receiving area 11.

Figure 5:
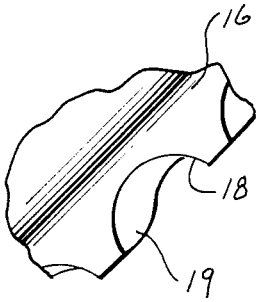
FIG. 5 is an enlarged elevational view of a portion of the container of FIG. 1, in which the container is tilted at an angle suitable for consumption of the contents.

In operation, the apparatus of the present invention works as follows. Liquid which is present on the exterior surface of cup 4, such as condensate or spillage, eventually collects in container-receiving area 11 of saucer 6. When the user lifts cup 4 off saucer 6, the liquid present in container-receiving area 11 tends to adhere to flange 16 of cup 4. Indentations 18 serve to reduce the surface area on the interior and exterior sides of flange 16 to which the liquid can adhere. Thus, the areas of flange 16 between indentations 18 tend to shed the liquid present within container-receiving area 11 when cup 4 is lifted from saucer 6. However, it is inevitable that a certain amount of liquid adheres to flange 16. The liquid which does so adhere to flange 16, and which presents a potential for dripping, is drawn into indentations 18, as shown in FIG. 5. When cup 4 is lifted and tilted to an angle suitable for emptying the contents, the liquid found in indentations 18 tends to remain there. It appears that the surface tension formed by the drops of liquid located within indentations 18, such as that shown at 19, is sufficient to overcome the forces which tend to make the liquid drip from cup 4. Thus, during a normal drinking sequence, liquid which is present within container-receiving area 11 is either shed by the areas of flange 16 between indentations 18 so as to remain on the saucer, or is retained within indentations 18 by surface tension as cup 4 is lifted, so that no dripping from the cup occurs.

The liquid-shedding and retention properties of flange 16, as modified by indentations 18, are optimal when the topmost portion of the arc of indentations 18 is at a higher elevation than the top of lip 10 in view of the venting so provided, the amount of liquid contacting flange 16 and the amount of surface tension required to retain liquid within indentations 18 during use. Further, it appears that the areas of flange 16 between indentations 18 are best able to shed liquid when the liquid is at a lower-elevation than the top of the indentations 18.

Figure 4:
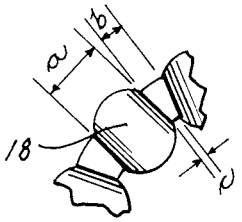
FIG. 4 is an enlarged detail plan view of the bottom flange of the container of FIG. 1.

Referring to FIG. 4, the following dimensions for indentations 18 have been found to be preferred. Dimension "a", the width of each indentation, is approximately $\frac{1}{4}$ inch. Dimension "b", the outer peripheral dimension of flange 16, is approximately 1/16 inch, and dimension "c", the inner circumferential dimension of flange 16, is approximately 1/32 inch. Further, it has been found that the depth of each indentation 18 should be approximately $\frac{1}{8}$ inch, which is sufficient to place the topmost point of each indentation at a higher elevation than lip 10 of saucer 6 and thus above the level of the liquid within container-receiving area 11.

While the present invention has been exemplarily described with reference to a cup and saucer, it will be appreciated that the present invention may also be employed with other containers, such as glasses or pitchers, and with coasters or even table tops.

Various modes for carrying out the invention are contemplated as being within the scope of the following claims particularly pointing out and distinctly claiming the subject matter which is regarded as the invention.

I claim:

1. An apparatus having a drip prevention feature, and comprising:

a saucer having an upstanding lip defining a container-receiving area thereon in which liquid may collect; and a container having a liquid-receiving body, said body being provided at its bottom with a flange adapted to fit on said container-receiving area of said saucer, said flange having a series of indentations formed therein, said indentations being spaced from one another so as to form a series of substantially flat areas about the bottom of said flange between said indentations, said flat areas between said indentations being substantially in the shape of a trapezoid, said indentations being formed so that liquid adhering to said flange when said container is removed from said saucer is retained within said indentations and thereby prevented from dripping from said container.

2. The apparatus of claim 1, wherein said areas on the side of said flange between said indentations shed liquid present within said container-receiving area of said saucer when said container is lifted upwardly off said saucer.

3. The apparatus of claim 1, wherein said indentations extend above the top of said upstanding lip of said saucer when said bottom of said container is placed within said container-receiving area of said saucer.

4. The apparatus of claim 1, wherein said flange is substantially circular, and wherein said indentations are spaced about the circumference of said circular flange.

5. The apparatus of claim 4, wherein said indentations are arcuate in cross-section.

6. The apparatus of claim 5, wherein the topmost point of the arc of said indentations extends above the top of said lip of said saucer.

7. The apparatus of claim 4, wherein said indentations are ¼ inch in width.

8. The apparatus of claim 4, wherein the outer edges of said substantially flat trapezoidal areas on the bottom of said flange between said indentations have an outer dimension of approximately 1/16 inch.

9. An apparatus for providing dripless consumption of a liquid and comprising:

a saucer presenting a concave surface, said concave surface having an upstanding circular lip defining an enclosed container-receiving area thereon in which liquid may collect; and a container having a liquid-receiving body, said body being provided at its bottom with a circular flange adapted to fit within said container-receiving area of said saucer, said circular flange having a series of arcuate indentations formed therein, said indentations being spaced from one another so as to form a series of substantially flat areas about the bottom of said flange between said indentations, said areas between said indentations being substantially in the shape of a trapezoid, the topmost point of said indentations extending above the top of said saucer lip when said bottom of said container is placed within said container-receiving area of said saucer, so that the liquid located on the exterior of said container and adhering to said flange is captured by and retained within said indentations when said container is removed from said saucer and tilted for emptying the liquid held in said body of said container, thereby preventing dripping of said liquid from said container.

10. The apparatus of claim 9, wherein said areas on the side of said flange between said indentations shed liquid present within said container-receiving area of said saucer when said container is lifted upwardly off said saucer.

11. The apparatus of claim 9, wherein said indentations are ¼ inch in width.

12. The apparatus of claim 9, wherein the outer edges of said substantially flat trapezoidal areas on the bottom of said flange between said indentations have an outer dimension of approximately 1/16 inch.

13. An apparatus for providing dripless consumption of a liquid and comprising:

a surface having a container-receiving area in which liquid may collect; and a container having a liquid-receiving body, said body being provided at its bottom with a closed flange adapted to fit within said container-receiving area of said surface, said flange having a series of arcuate indentations formed therein, said indentations being spaced from one another so as to form a series of substantially flat areas about the bottom of said flange between said indentations, said flat areas between said indentations being substantially in the shape of a trapezoid, said indentations being formed so that the topmost point of said indentations extend above the liquid contained within said container-receiving area of said surface when said bottom of said container is placed within said container-receiving area, so that the liquid located on the exterior of said container and adhering to said flange is retained within said indentations when said container is removed from said container-receiving area of said surface and tilted and thereby prevented from dripping from said container.

14. The apparatus of claim 4, wherein the inner edges of said substantially flat trapezoidal areas on the bottom of said flange between said indentations have an inner dimension of approximately 1/32 inch.

15. The appartus of claim 9, wherein the inner edges of said substantially flat trapezoidal areas on the bottom of said flange between said indentations have an inner dimension of approximately 1/32 inch.

16. The apparatus of claim 13, wherein said flange is substantially circular, and wherein said indentations are spaced about the circumference of said circular flange.

17. The apparatus of claim 16, wherein the outer edges of said substantially flat trapezoidal areas on the bottom of said flange between said indentations have an outer dimension of approximately 1/16 inch.

18. The apparatus of claim 16, wherein the inner edges of said substantially flat trapezoidal areas on the bottom of said flange between said indentations have an inner dimension of approximately 1/32 inch.

* * * * *